US006035961A

United States Patent [19]

Sun

[11] Patent Number: 6,035,961

[45] Date of Patent: Mar. 14, 2000

[54] EARPHONE WITH A SOFT, COMPRESSIBLE HOUSING AND ADJUSTABLE EARPIECE LOOP

[76] Inventor: Ming-Han Sun, 7F, No. 213-2, Sec. 2, An-Ho Road, Taipei, Taiwan

[21] Appl. No.: 09/122,772

[22] Filed: Jul. 27, 1998

[51] Int. Cl.[7] ..... H04R 25/00

[52] U.S. Cl. ..... 181/129; 181/128; 181/126; 181/135; 381/328; 381/322; 381/312

[58] Field of Search ..... 181/129, 130, 181/135, 126, 128; 381/328, 329, 370, 371, 380, 381, 322, 312, 182, 150

[56] References Cited

U.S. PATENT DOCUMENTS

| | | | |
|---|---|---|---|
| D. 237,090 | 10/1975 | Yanagawa | D26/14 H |
| 824,773 | 7/1906 | Aiken | 381/370 |
| 1,668,890 | 5/1928 | Curran et al. | 381/370 |
| 1,668,910 | 5/1928 | Jones | 381/370 |
| 1,893,474 | 1/1933 | Lieber | 381/370 |
| 3,285,688 | 11/1966 | Wieszeck | 351/41 |
| 4,972,492 | 11/1990 | Tanaka et al. | 381/187 |
| 5,048,090 | 9/1991 | Geers | 381/68.6 |

FOREIGN PATENT DOCUMENTS 372654 1/1939 Italy .

*Primary Examiner*—Robert E. Nappi
*Assistant Examiner*—Edgardo San Martin
*Attorney, Agent, or Firm*—Smith, Gambrell & Russell, LLP

[57] ABSTRACT

An earcap type earphone having a flexible stretching configuration which includes an earphone housing, an ear loop and a speaker, wherein both the ear loop and the earphone housing can be produced and integrated into a one-piece-molded product or can be made separately and then assembled together later. Additionally, an expandable component is provided to allow the earphone to comfortably fit a variety of different ear sizes.

6 Claims, 5 Drawing Sheets

EARPHONE WITH A SOFT, COMPRESSIBLE HOUSING AND ADJUSTABLE EARPIECE LOOP

BACKGROUND OF THE INVENTION

The present invention relates to an earcap type of earphone which has a flexible stretching configuration, and more particularly, with components consisting of an earphone housing, an ear loop and a speaker, wherein there is an expandable, corrugated flexible component mounted on the loop portion of the ear loop. Also, a hollow protuberant ring is equipped on the flange of the speaker enclosure of the earphone housing so that the speaker can be inserted directly into the depression of the speaker frame in order to allow a firm and comfortable way to wear the earphone for a wide variety of ear shapes and sizes. Furthermore, this configuration creates a perfect resonant space for sound waves on the earcap type earphone and attains a better timbre, by partially isolating noise from the external environment.

DESCRIPTION OF THE RELATED ART

The earphone is a perfect transmitting tool for sound, which is applied widely in communication, teaching programs or music listening . . . etc., and after long term development, there are numerous types of earphones on the market, such as headsets, ear-plugs, and earcap types. Among these, the earcap type earphone is the most popular one, as it is neither equipped with a large and unwieldy headband like the headsets, nor is it as painful and uncomfortable to use as ear-plug type earphones, which also block the earhole of the person. As shown in FIG. 1, the known earcap type earphone has an earloop B connected to the back of the ear housing A, and the speaker C is formed and positioned on the interior surface of the ear housing A. The ear loop B must enclose the ear helixes of the user during use (because human ears are made of cartilage and are bendable, by merely bending the ear and then clipping on the ear loop B, the ear loop B will encircle the ear after the compressing force is released, and let the ear expand and return to its normal shape).

But there are some defects in the known earcap type earphones, as follows:

(1) Normally they are made from hard materials, both the ear loop B, and the ear housing A. Because the diameter of the loop is fixed, those kinds of ear loops B, produced according to one unified specification, are not suitable to match the different sizes of helixes of various persons properly. Thus, the person who has larger helixes would feel much pain after wearing it for a long time, and under the same circumstances, the person who has smaller helixes would face problems on wearing it, in that it will fall off easily and not be sufficiently fixed to the ear.

(2) The speaker C will be aligned with the interior surface of the housing A when mounted in the housing A (This means that it will align to the surface of the user's ear.) There is a slight, tilting, bulgy component of the earphone located at a position in front of a human's ear, so that, upon wearing the earphone, the bulgy component of the speaker will abut and press directly on the earhole. This consequently creates a gap in between, and hence prevents the component of the speaker from being positioned closely with the ear. This situation further results in the following problems: 1) the earphones are slippery and become uncomfortable to wear; and 2) it is impossible for the earphone to isolate effectively the external noise, with the result that these noises strongly influence the clearness and quality of the sound.

SUMMARY OF THE INVENTION

In view of the defects described above from the known earcap type earphones, and based on quite a lot of experience of the inventor in researching and production in the fields related to all kinds of earphones, microphones, and related products, it is desired to provide a stretching and flexible component to be mounted into the body of an ear loop, and it is also desired to provide a configuration which allows the speaker to be positioned into a deeper place of the speaker frame on the earphone housing so as to offer an earcap type earphone which has a flexible and stretching configuration. This configuration provides the advantages of being more comfortable, more stable, and better preforming as to fit; and it also improves the timbre as well.

DETAILED DESCRIPTION OF THE INVENTION

Figure 1:
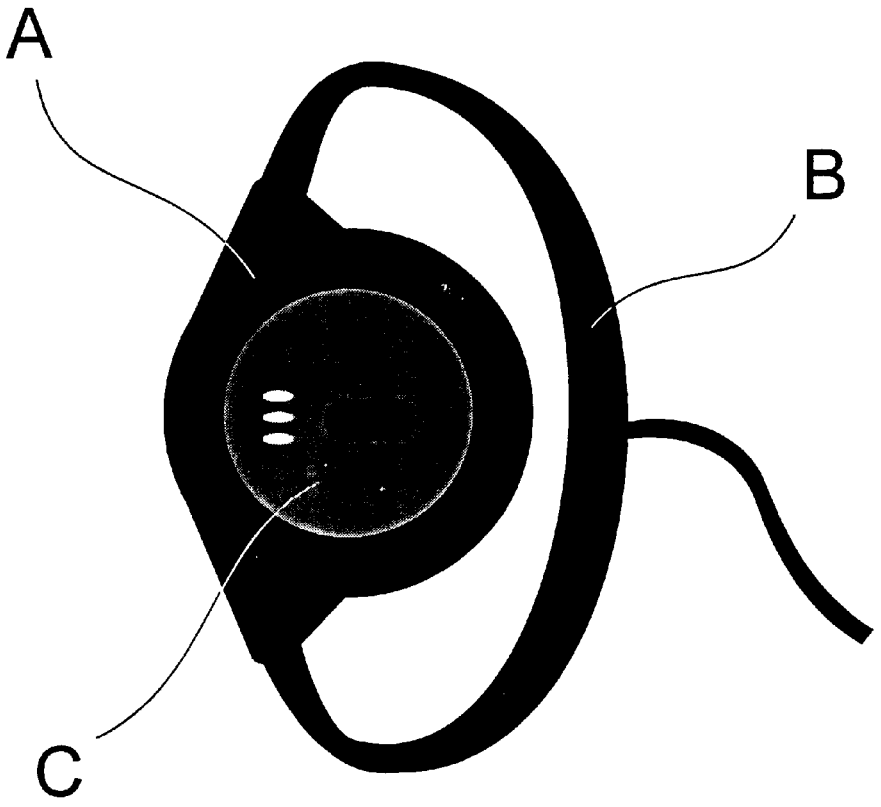
Fig.1 PRIOR ART
FIG. 1 is a sketch view of the known earcap type of earphone.
Figure 2:
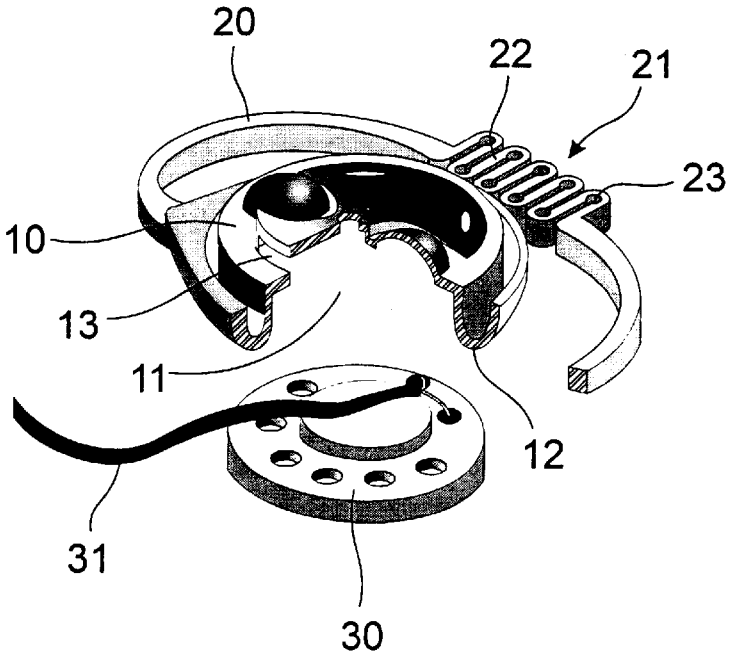
FIG. 2 is an exploded sketch view of the present invention.
Figure 3:
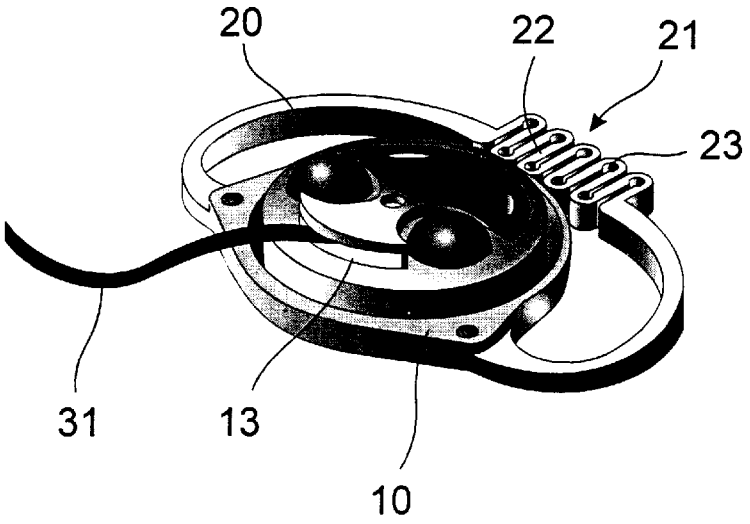
FIG. 3 is an assembled outward appearance view of the present invention.

An embodiment of the present invention will now be described by way of example with reference to the accompanying drawings. With reference to FIGS. 2–8, the present invention comprises the earphone housing 10, the ear loop 20, and speaker 30 etc. These elements are described in more detail below.

Earphone Housing 10: it is equipped inside with a speaker enclosure 11, and at the flange on the interior surface of the enclosure 11 (the right position that contacts with the ear of the user), a hollow protuberant ring 12 is integrated into the one-piece-molded product, wherein an interior diameter of the ring 12 is a little bit smaller than the exterior diameter of the speaker 30. Additionally there is a slot 13 on the exterior surface of the speaker enclosure 11.

Figure 4:
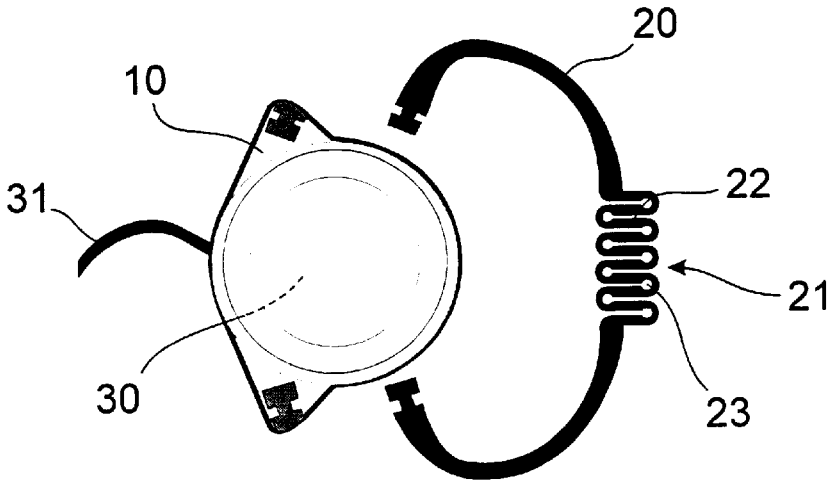
FIG. 4 is an exploded sketch view for a model of the present invention which illustrates the earphone housing and the ear loop produced separately.
Figure 5:
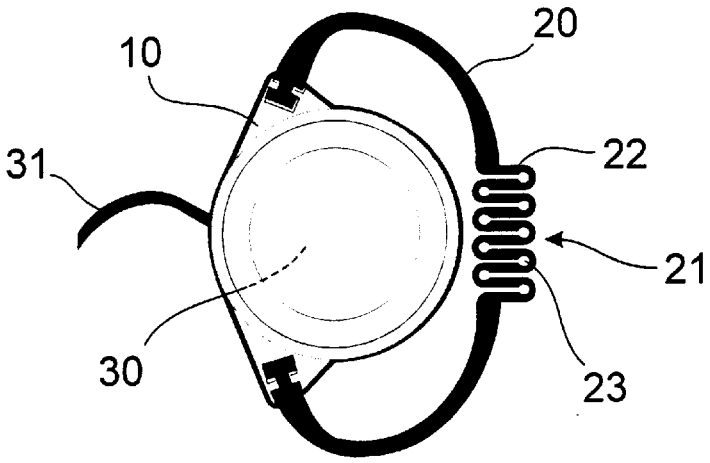
FIG. 5 is an assembled sketch view for the model of the present invention which illustrates the earphone housing and the ear loop produced separately.

Ear Loop 20: it is to be made of flexible materials (such as soft PVC materials, rubber or silica gel etc.) and is connected to the back of the earphone housing 10 and can be made and integrated with the earphone housing 10 into a one-piece-molded product (as the embodiment described in FIGS. 2–3; and under this circumstance, the material of the earphone housing 10 is the same as for the ear loop 20), or alternatively, it can be produced separately and can then be assembled together with the earphone housing 10 later (as the embodiment described in FIGS. 4–5; and under this circumstance, the material of the earphone housing 10 can be the same as the ear loop 20, or a different kind of material can be used, if needed.) At an appropriate position of the ear loop 20 (at the center position normally), there are multiple portions of flexible components 21 which are made of corrugated materials 22 that extend continuously in reverse directions. In order to be conducive to easily stretching, there are sub-holes 23 positioned at the turning points of the corrugated materials 22.

Speaker 30: it has a proper size diameter on the vibrating diaphragm and has an exterior diameter a little bit larger than the interior diameter which is positioned at the flange on the speaker enclosure 11 for the above earphone housing 10. Additionally, a signal wire 31 extends from one side.

Figure 6:
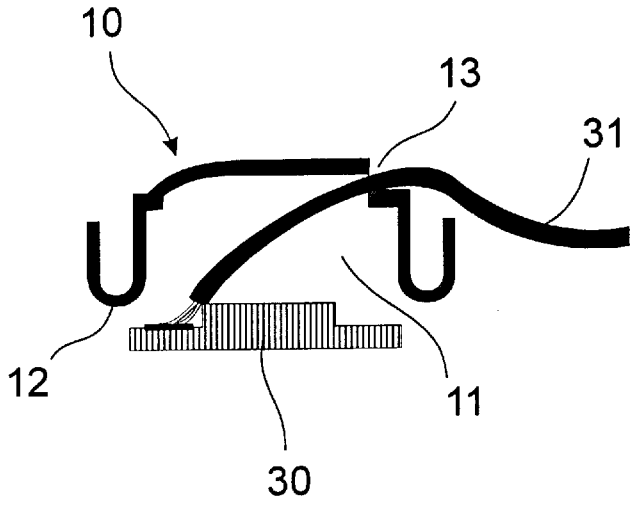
FIGS. 6 and 7 are partial cross section views of the present invention which illustrate the earphone housing and the speaker assembled together.
Figure 7:
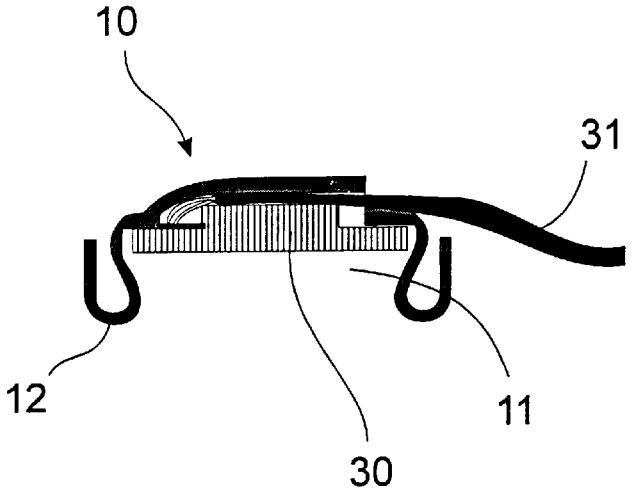
Figure 8:
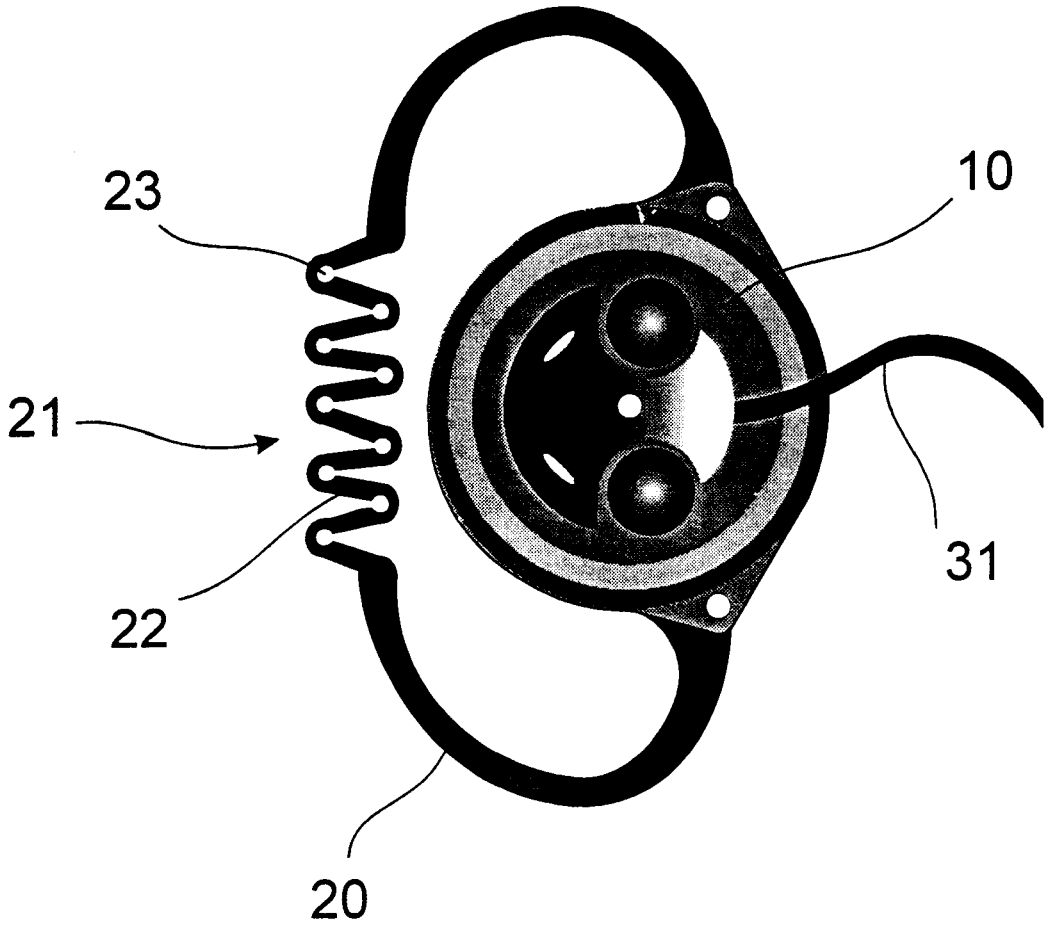
FIG. 8 is a sketch view of the present invention which illustrates the ear loop expanded properly.

According to this configuration, the difference in diameters between the speaker 30 and the flange of the speaker enclosure 10 (the hollow protuberant ring 12) is such that the speaker 30 is a little bit larger than the protuberant ring 12. Because of the particular flexible characteristics arising from the sectional configuration of the hollow protuberant ring 12, it is possible to assemble the speaker 30 in the housing by compressing the speaker 30 through the hollow protuberant ring 12, and hence to be positioned into the speaker enclosure 11 as is illustrated in FIGS. 6–7. The signal wire 31 would thus be able to extend from the earphone housing 10 through slot 13. Thus, because the exterior diameter of speaker 30 is a little bit larger than the interior diameter of the flange on the speaker enclosure 11, instead of falling off, the speaker will be assembled firmly.

A resonant space is thus created, to transmit sound waves of the speaker 30 at the area between the speaker 30 and the flange in the speaker enclosure 11. Additionally, with the characteristics of this special configuration, the flexible component 21 on the ear loop 20 will allow the stretching and contracting features of the corrugated material 22 on the flexible component 21 and hence result in stretching or contracting of its diameter accordingly.

With the special design of the configuration, the efficacies of the present invention are:

(1) the ear loop 20 is made of flexible materials and is equipped with an expandable component 21 in order to do the proper stretching or contraction in diameter. It is therefore useful for various users with different sizes of helix, and thus it is practical to obtain the most comfortable fit, by utilizing the ear loop of the present invention. Moreover, it provides a widely applicable loop which will be able to improve the stability of the earcap on the helix, and also provides a great improvement in the accuracy of alignment between the speaker 30 and the ear.

(2) to wear the ear loop of the present invention, it is most suitable to abut the dimpling place of the ears (the area around the ear hole) with the flange of the speaker enclosure 11 in the speaker housing 10 (the hollow protuberant ring 12) and under this circumstance, it becomes and creates a resonant space inside of the speaker enclosure 11, resulting in a closer contact between the earphone housing 10 and the ears. Additionally, because the gap between the earphone housing 10 and the ears is reduced or even disappears, the exterior noise is much reduced hence isolating the exterior noise successfully. Further, by means of utilizing the buffering from the resonant space while transmitting the sound waves, it will achieve a better and clearer sound quality music performance.

(3) while assembling the speaker 30 with the earphone housing 10, it is not necessary to use any glue or spare-parts. Therefore, it is easy to assemble the product. This results in both low cost and high efficiency in manufacturing.

According to the advantages of the invention, the brand new design of the comprehensive configuration not only corrects the defects of known earphones, which are uncomfortable to wear, have improper sizing, are difficult to isolate from exterior noise, and have inferior timbre, etc., but it also improves the efficacies of the earphone both in use and in production.

Although preferred embodiments have been disclosed, other embodiments and modifications of the invention are intended to be covered by the spirit and scope of the appended claims.

What is claimed is:

1. A flexible, adjustable earphone, comprising:

a housing, comprised of an elastomeric material, and provided with an interior surface, and a protuberant ring about an outer portion of the interior surface, and extending from the interior surface, wherein a speaker enclosure for receiving a speaker is defined by the interior surface and the protuberant ring;

an ear loop, attached to the housing, provided with means for the ear loop to stretch at least with respect to its length; and a speaker, having an exterior diameter at least slightly larger than a diameter of the speaker enclosure, positioned within the speaker enclosure.

2. The earphone according to claim 1, further provided with a signal wire, operably attached to the speaker, which extends from the speaker through a slot defined in the housing.

3. The earphone according to claim 1, wherein the housing and the ear loop are comprised of the same material, and are formed integrally together.

4. The earphone according to claim 1, wherein the housing and the ear loop are comprised of the same material, and are formed from two separate pieces.

5. The earphone according to claim 1, wherein the means for the ear loop to stretch comprises multiple corrugations formed in the ear loop.

6. The earphone according to claim 5, wherein the multiple corrugations are formed with sub-holes positioned at turning points of the corrugations.

* * * * *